US006525734B2

(12) United States Patent
Sato et al.

(10) Patent No.: US 6,525,734 B2
(45) **Date of Patent: *Feb. 25, 2003**

(54) DISPLAY CONTROL APPARATUS, DISPLAY CONTROL METHOD AND COMPUTER PROGRAM PRODUCT

(75) Inventors: Chikako Sato, Kawasaki (JP); Junichi Iizuka, Kawasaki (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/814,275

(22) Filed: Mar. 10, 1997

(65) Prior Publication Data

US 2001/0048437 A1 Dec. 6, 2001

(30) Foreign Application Priority Data

Sep. 17, 1996 (JP) ..... 8-244426

(51) Int. Cl.[7] ..... G09G 5/26

(52) U.S. Cl. ..... 345/472; 345/472.1; 345/472.2; 345/660

(58) Field of Search ..... 345/112, 117, 345/126, 127, 128, 129, 130, 141, 471, 472, 472.1, 472.2, 472.3, 660, 670, 671, 668; 707/518, 523, 530, 531

(56) References Cited

U.S. PATENT DOCUMENTS

| | | | | | |
|---|---|---|---|---|---|
| 4,682,161 | A | * | 7/1987 | Bugg | 345/130 |
| 4,823,303 | A | * | 4/1989 | Terasawa | 345/127 |
| 4,827,358 | A | * | 5/1989 | Matsumoto | 358/296 |
| 4,951,233 | A | * | 8/1990 | Fujiwara et al. | 707/523 |
| 5,042,075 | A | * | 8/1991 | Sato | 382/299 |
| 5,231,579 | A | * | 7/1993 | Tsuchiya et al. | 707/508 |
| 5,262,760 | A | * | 11/1993 | Iwamura et al. | 345/145 |
| 5,495,577 | A | * | 2/1996 | Davis et al. | 707/542 |
| 5,562,350 | A | * | 10/1996 | Sakurai | 400/61 |
| 5,595,450 | A | * | 1/1997 | Beadman et al. | 400/15.2 |
| 5,790,093 | A | * | 8/1998 | Takahashi | 345/141 |
| 5,883,624 | A | * | 3/1999 | Teramura et al. | 345/339 |

OTHER PUBLICATIONS

Corel WordPerfect version 6.1 for windows, Mar. 29, 1996.*

* cited by examiner

*Primary Examiner*—Steven Saras
*Assistant Examiner*—Amr Awad
(74) *Attorney, Agent, or Firm*—Staas & Halsey LLP

(57) ABSTRACT

A display control apparatus controls attributes of characters to be displayed on a display unit. The display control apparatus includes a storage storing predetermined attributes, and a converter for converting attributes of each of characters making up an input character string by referring to the storage so that characters making up a converted character string have the predetermined attribute. The converted character string is output for display on the display unit.

41 Claims, 12 Drawing Sheets

FIG. 4A

| CHARACTER CODE | CHARACTER SIZE | FONT TYPE | COLOR | SLANT ANGLE | | |
|---|---|---|---|---|---|---|
| A | 9 POINTS | MINCHO TYPEFACE | WHITE | 0 | | |
| b | 12 POINTS | GOTHIC | WHITE | 30 | | |
| c | 9 POINTS | MINCHO TYPEFACE | RED | 15 | | |
| D | 15 POINTS | TEXTBOOK TYPE | RED | 10 | | |
| SPACE | | | | | | |
| SPACE | | | | | | |
| E | 12 POINTS | TEXTBOOK TYPE | BLACK | 45 | | |
| F | 9 POINTS | MINCHO TYPEFACE | WHITE | 10 | | |

ELIMINATE SUCCESSIVE SPACES

FIG. 4C

| CHARACTER CODE | CHARACTER SIZE | FONT TYPE | COLOR | SLANT ANGLE | | |
|---|---|---|---|---|---|---|
| A | 50 POINTS | BOLD GOTHIC | BLACK | 0 | | |
| b | 50 POINTS | BOLD GOTHIC | BLACK | 0 | | |
| c | 50 POINTS | BOLD GOTHIC | BLACK | 0 | | |
| D | 50 POINTS | BOLD GOTHIC | BLACK | 0 | | |
| SPACE | | | | | | |
| E | 50 POINTS | BOLD GOTHIC | BLACK | 0 | | |
| F | 50 POINTS | BOLD GOTHIC | BLACK | 0 | | |

DISPLAY CONTROL APPARATUS, DISPLAY CONTROL METHOD AND COMPUTER PROGRAM PRODUCT

TECHNICAL FIELD OF THE INVENTION

The present invention generally relates to display control apparatuses, display control methods and computer program products, and more particularly to a display control apparatus and a display control method which convert a character string made up of a mixture of characters having a plurality of different character attributes into a character string made up of characters having a unified character attribute and displays the character string with the unified character attribute, and to a computer program product for realizing such a conversion and display of the character string.

BACKGROUND OF THE INVENTION

Recently, information processing equipments such as personal computers and word processors have become inexpensive, thereby increasing the use of such information processing equipments professionally in industry and personally at homes. In a multi-window system, it has become possible to treat data in which various attribute information coexist, the attribute information being the type of character, size of character and the like. Therefore, there are increasing demands to efficiently enlarge or reduce the data to make the data easily readable on a display.

According to the conventional multi-window system, the character types (or font types) and the character sizes are various even within one window. However, when enlarging the display of the window, the characters within the window are enlarged by the same magnification regardless of the font types and the character sizes. For this reason, when different font types and/or character sizes coexist within the window, the enlargement of the characters by the same magnification resulted in the display of characters having various different sizes within the window. In addition, even if the characters within the window are slanted, rotated or colored by a color which is difficult to see, such characters are also uniformly enlarged by the same magnification and displayed.

Therefore, according to the conventional system, there was a problem in that the amount of information displayable within the window became insufficient when the characters within the window were enlarged, because the magnification was set in order to facilitate reading of the character having the smallest size and to the same value for all characters within the window regardless of the original font types, sizes, slants, rotations and colors. On the other hand, when the magnification was reduced to a value such that the character having the largest size within the window became more easily readable, there was a problem in that the character having the smallest size within the window became difficult to read even after the enlargement because of the reduced and insufficient magnification.

Further, there was another problem in that special font types such as slanted characters were difficult to read when enlarged.

SUMMARY OF THE INVENTION

Accordingly, it is a general object of the present invention to provide a novel and useful display control apparatus, display control method and computer program product, in which the problems described above are eliminated.

Another and more specific object of the present invention is to provide a display control apparatus, display control method and computer program product, which convert a character string made up of a mixture of characters having a plurality of different character attributes into a character string made up of characters having a unified character attribute and display the character string with the unified character attribute, so that the converted character string is easily readable when displayed and a large amount of information is displayable within a window even after the conversion.

Still another object of the present invention is to provide a display control apparatus which controls attributes of characters to be displayed on a display unit, comprising storage means for storing predetermined attributes, converter means for converting attributes of each of characters making up an input character string by referring to the storage means so that characters making up a converted character string have the predetermined attribute, and means for outputting the converted character string for display on the display unit. According to the display control apparatus of the present invention, the input character string can be automatically displayed in a most easily readable and recognizable form, by converting the attributes of the characters making up the input character string using contents of the storage means and displaying the converted character string made up of the characters having a unified attribute that is easily readable and recognizable when displayed. In addition, it is possible to display a large amount of information in easily readable and recognizable form, even within a window having a limited area, for example, by displaying the converted character string.

A further object of the present invention is to provide a display control method which controls attributes of characters to be displayed on a display unit, copmrising the steps of storing predetermined attributes in storage means, converting attributes of each of characters making up an input character string by referring to the storage means so that characters making up a converted character string have the predetermined attribute, and outputting the converted character string for display on the display unit. According to the display control method of the present invention, the input character string can be automatically displayed in a most easily readable and recognizable form, by converting the attributes of the characters making up the input character string using contents of the storage means and displaying the converted character string made up of the characters having a unified attribute that is easily readable and recognizable when displayed. In addition, it is possible to display a large amount of information in easily readable and recognizable form, even within a window having a limited area, for example, by displaying the converted character string.

Another object of the present invention is to provide a computer program product having a computer readable medium having computer program logic recorded thereon for performing attribute conversion with respect to characters to be displayed on a display unit, comprising storage means for storing predetermined attributes, converter means for converting attributes of each of characters making up an input character string by referring to the storage means so that characters making up a converted character string have the predetermined attribute, and means for outputting the converted character string for display on the display unit. According to the computer program product of the present invention, the input character string can be automatically displayed in a most easily readable and recognizable form, by converting the attributes of the characters making up the input character string using contents of the storage means and displaying the converted character string made up of the characters having a unified attribute that is easily readable and recognizable when displayed. In addition, it is possible to display a large amount of information in easily readable and recognizable form, even within a window having a limited area, for example, by displaying the converted character string.

Other objects and further features of the present invention will be apparent from the following detailed description when read in conjunction with the accompanying drawings.

BRIEF DESCRIPTION OF THE DRAWINGS

FIGS. 4A, 4B and 4C respectively are diagrams for explaining the operation of converting characters in the first embodiment;

DESCRIPTION OF THE PREFERRED EMBODIMENTS

Figure 1:
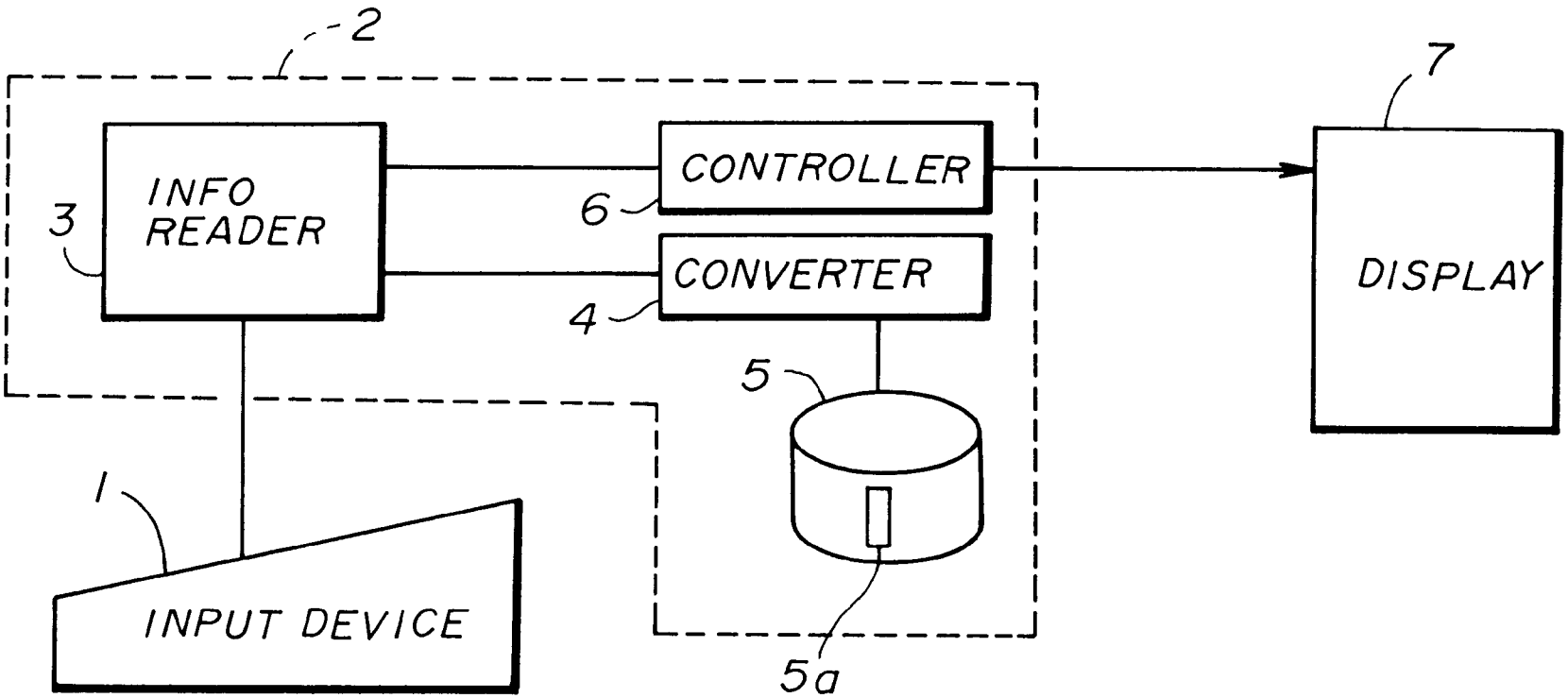
FIG. 1 is a system block diagram showing a first embodiment of a display control apparatus according to the present invention.

FIG. 1 shows a first embodiment of a display control apparatus according to the present invention. This embodiment of the display control apparatus employs a first embodiment of a display control method according to the present invention and a first embodiment of a computer program product according to the present invention.

In other words, the present invention includes a computer program product which is a storage medium including instructions which can be used to program a computer to perform a process of the invention, that is, the process of the display control apparatus. The storage medium can include, but is not limited to, any type of disk including floppy disks, optical disks, CD-ROMs, and magneto-optical disks, ROMs, RAMs, EPROMs, EEPROMs, magnet or optical cards, or any type of media suitable for storing electronic instructions.

A display control apparatus shown in FIG. 1 includes an input device 1, a character display control unit 2, and a display unit 7. The character display control unit 2 includes an information reader 3, a converter 4, a storage medium 5, and a controller 6. The information reader 3, the converter 4 and the controller 6 may be realized by a processor such as a CPU, and in this case, the storage medium 5 stores data and programs to be executed by the CPU. The storage medium 5 is not limited to a specific type, and may be any type of disk including floppy disks, optical disks, CD-ROMs, and magneto-optical disks, ROMs, RAMs, EPROMs, EEPROMs, magnet or optical cards, or any type of media suitable for storing electronic instructions.

The input device 1 is made up of a keyboard, a mouse or the like, and inputs input information to the display control unit 2. The input information includes various data and instructions. The various data input from the input device 1 includes characters and character strings to be displayed on the display unit 7, attribute information related to characters, and conversion information to be registered in an attribute information conversion table 5*a* which is stored in the storage medium 5. In this specification, the "characters" include alpha-numeric characters, Japanese Hiragana and Katakana characters, Chinese or Japanese Kanji Characters, symbols and the like which can be displayed on the display unit 7.

The display control unit 2 carries out various processes depending on the programs. The information reader 3 reads the character information and the attribute information input from the input device 1. The converter 4 refers to the attribute information conversion table 5*a* within the storage medium 5 based on the character information and the attribute information read by the information reader 3, and converts the input character string into a more easily readable character string, that is, a character string that is more easily recognized by the user, depending on conversion information read from the attribute information conversion table 5*a*.

The conversion information is used to convert the character string which is to be displayed and includes a mixture of different character attributes into a character string which is more easily readable and includes a unified character attribute. This conversion information is registered in advance in the attribute information conversion table 5*a*. For example, parameters are registered in advance in the attribute information conversion table 5*a* in correspondence with the various attributes such as the character size, font type, color, slant angle, rotation angle, character pitch, and delete indication. In other words, values corresponding to the various attributes are registered in the attribute information conversion table 5*a*.

The controller 6 controls the display so as to display the original character string which is input from the input device 1 within a window on the display unit 7 or, to display the character string which is converted into the more easily readable form within a window on the display unit 7, for example. The display unit 7 displays various information output from the display control unit 2, including windows.

Figure 2:
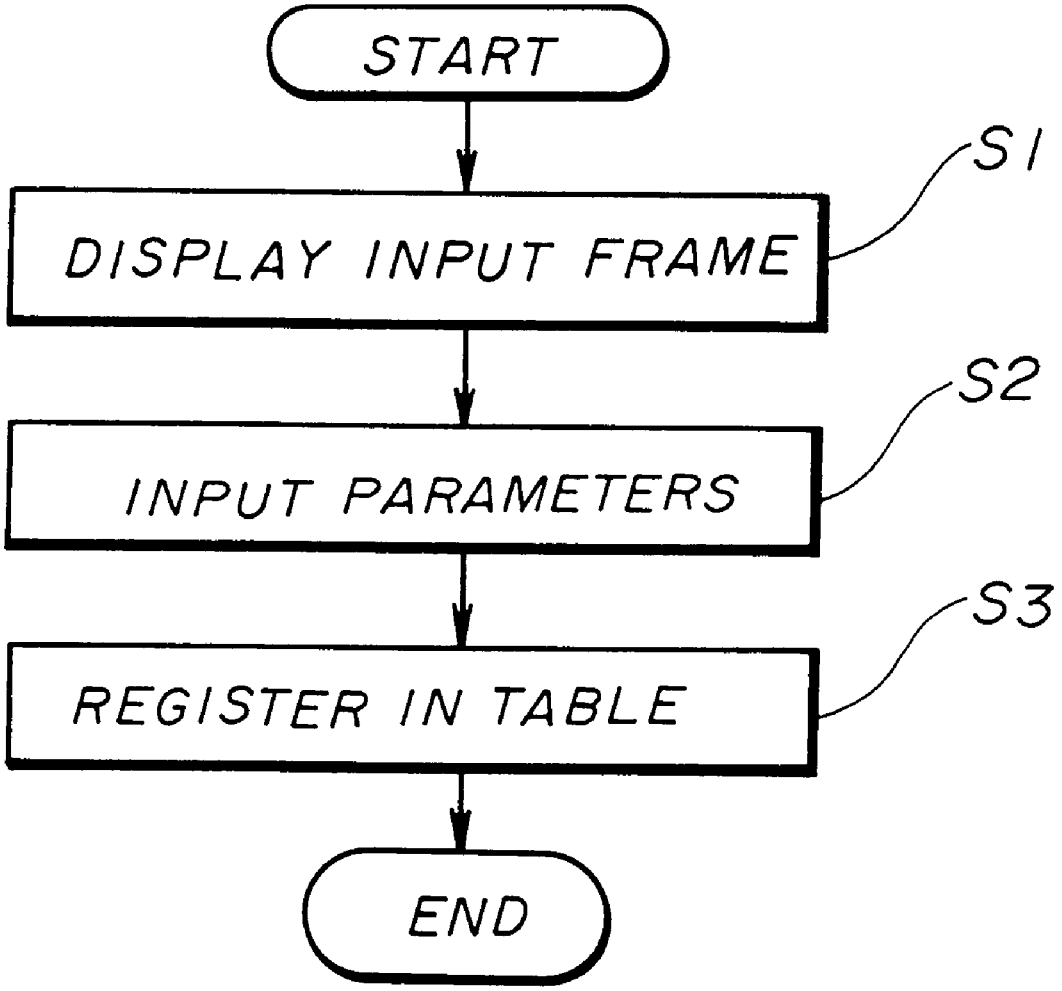
FIG. 2 is a flow chart for explaining the operation of creating an attribute information conversion table.

Next, a description will be given of the operation of creating the attribute information conversion table 5*a*, by referring to FIG. 2. FIG. 2 is a flow chart for explaining the operation of the display control apparatus, more particularly, the operation of the CPU forming the display control apparatus, when creating the attribute information conversion table 5*a* in this embodiment.

Figure 4B:
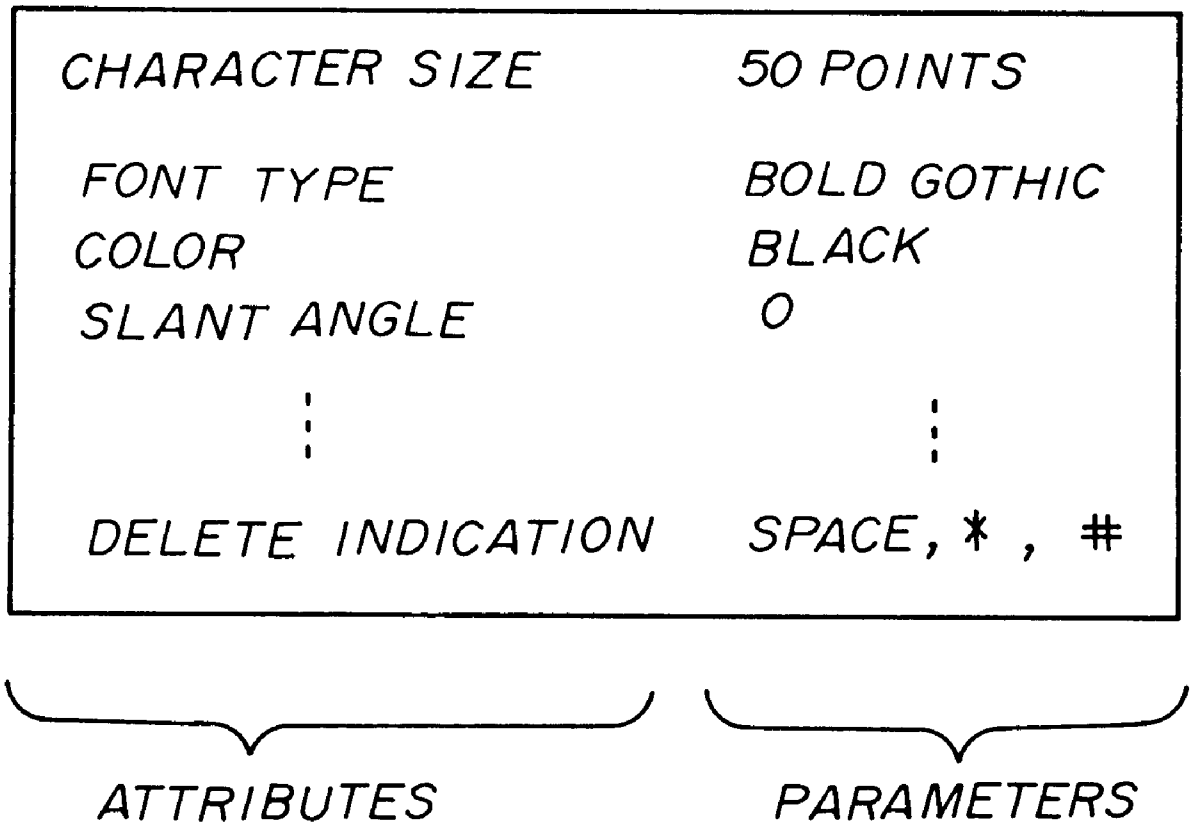

In FIG. 2, a step S1 displays an input frame on the display unit 7 based on the input information input from the input device 1. A step S2 inputs the parameters from the input device 1. As shown in FIG. 4B which will be later, the attribute information conversion table 5*a* displayed on the display unit 7 includes the attributes in the left column, and default values of the parameters in correspondence with the attributes. In the steps S1 and S2, the parameters suited for displaying a character string which is made up of characters having different character attributes as a converted character string which is made up of characters having a unified character attribute and is easily readable are input and overwrite the default values. Of course, the default values are unchanged if suitable. In addition, if an attribute does not exist in the attribute information conversion table 5*a*, this attribute is first input from the input device 1 and parameters of this attribute are input thereafter.

After the steps S1 and S2, a step S3 registers the input parameters, and the attributes if applicable, in the attribute information conversion table 5*a* which is stored in the storage medium 5.

By the above described operation, the attribute information conversion table 5*a* is registered with the conversion information that is used to convert the character string which is made up of characters having different character attributes into the converted character string which is made up of characters having a unified character attribute so that the character string is more easily readable on the display.

Figure 3:
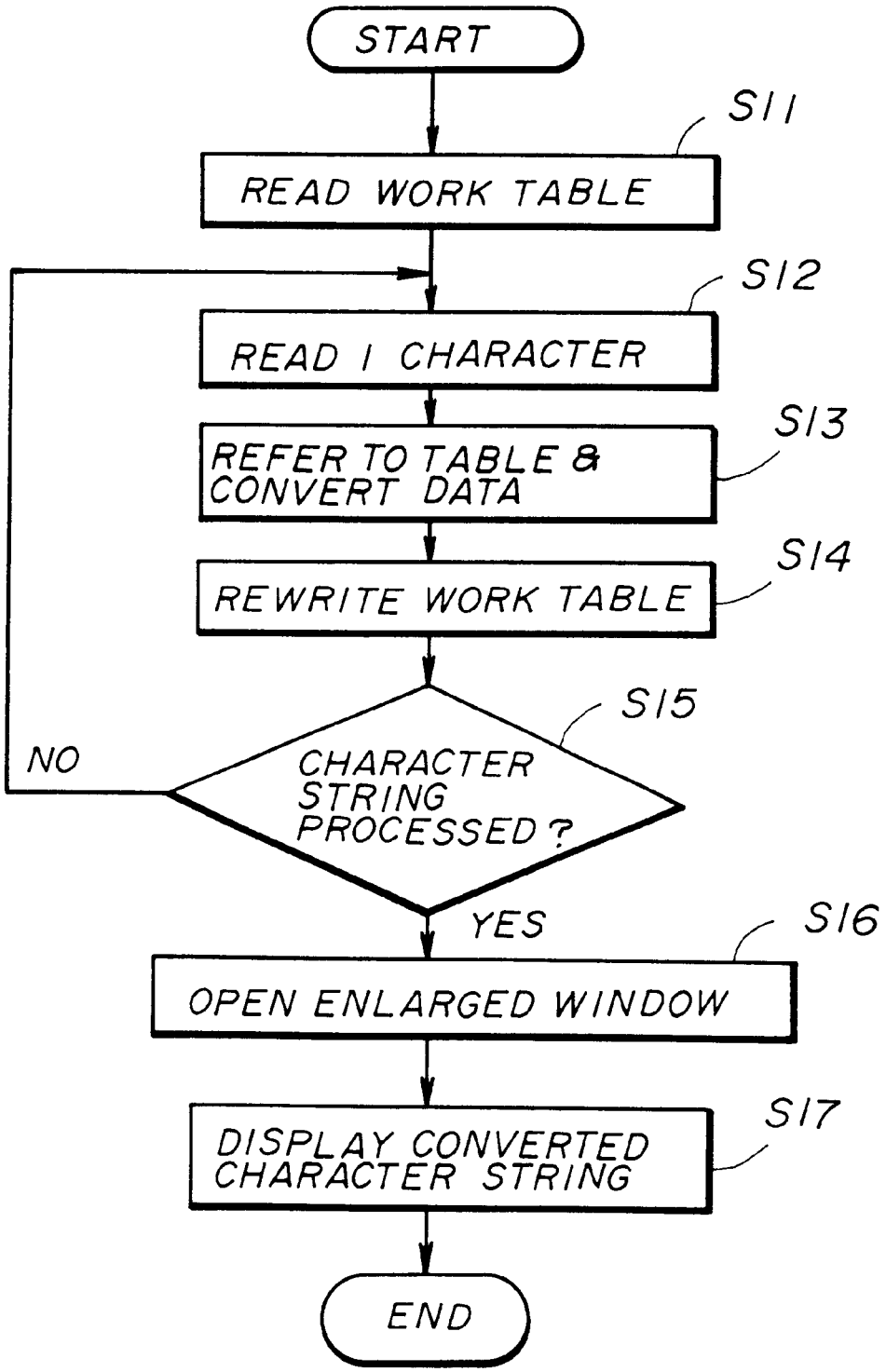
FIG. 3 is a flow chart for explaining the operation of converting and displaying characters in the first embodiment.

Next, a description will be given of the operation of the converting and displaying characters, by referring to FIG. 3. FIG. 3 is a flow chart for explaining the operation of the display control apparatus, more particularly, the operation of the CPU forming the display control apparatus, when converting and displaying the characters, so that the displayed character string is made up of characters having a unified character attribute that are more easily readable on the display in this embodiment. Hence, FIG. 3 corresponds to an important part of the first embodiment of the display control method.

In FIG. 3, a step S11 reads a work table from the storage medium 5. In other words, a work table shown in FIG. 4A, prior to the data conversion, is set with respect to a character string which is input from the input device 1, and the step S11 reads this work table from the storage medium 5.

A step S12 reads 1 character from the work table. For example, data related to 1 character which is to be displayed are read from the work table shown in FIG. 4A which is read in the step S11, starting from the top of the work table. In this particular case, the data related to 1 character include the character code, character size, font type, color and slant angle.

A step S13 converts the data related to the 1 character read in the step S12 by referring to the attribute information conversion table 5*a* shown in FIG. 4B. The data related to the first character read from the top of the work table shown in FIG. 4A are as follows.

Character Code: A

Character Size: 9 Points

Font Type: Mincho Typeface

Color: White

Slant Angle: 0°

On the other hand, the attribute information conversion table 5*a* shown in FIG. 4B include the following data.

Character Size: 50 Points

Font Type: Bold Gothic

Color: Black

Slant Angle: 0°

.

.

.

Delete Indication: Blank, *, #

Hence, with respect to the first character, the data in the work table shown in FIG. 4A are converted into the following data by making a data conversion with reference to the attribute information conversion table 5*a* shown in FIG. 4B, where each underlined portion indicates a parameter which is converted using the attribute information conversion table 5*a* in order to make the character of the character string more easily readable on the display.

Character Code: A

Character Size: 50 Points

Font Type: Bold Gothic

Color: Black

Slant Angle: 0°

A step S14 rewrites the work table using the converted data obtained in the step S13. Hence, the data (parameters) in the first row of the work table shown in FIG. 4A are rewritten by the converted data as shown in the first row of the rewritten work table shown in FIG. 4C after the data conversion.

A step S15 decides whether or not all of the characters making up the input character string are processed. If the decision result in the step S15 is NO, the process returns to the step S11 to process the next character. On the other hand, if the decision result in the step S15 is YES, the process advances to a step S16.

Figure 5B:
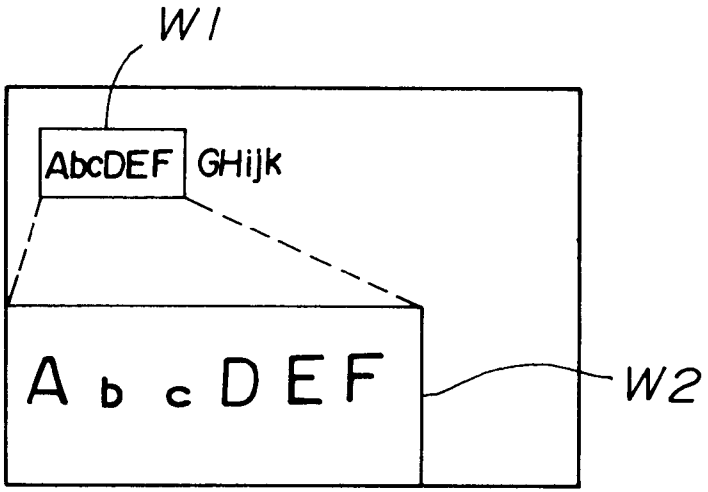
FIGS. 5A and 5B respectively are diagrams showing original and enlarged windows.
Figure 5A:
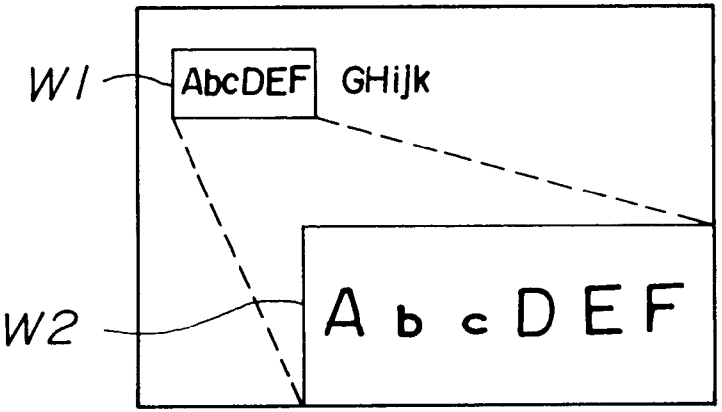

The step S16 opens an enlarged window by enlarging an original window displayed on the display unit 7. For example, in a case where the original window is displayed at the top left portion of the display, the enlarged window is displayed at the bottom right portion of the display as shown in FIG. 5A. On the other hand, in a case where the original window is displayed at the top left portion of the display, the enlarged window is displayed at the bottom left portion of the display as shown in FIG. 5B. In other words, the enlarged window is displayed at a location within the display so as not to overlap the original window or, so as to prevent the contents of the original window from being hidden behind the enlarged window. The enlarged window may of course be displayed at the position of the original window in place of the original window by erasing the original window, for example.

Then, a step S17 displays the character string which is made up of the characters having the converted character attributes based upon the rewritten work table shown in FIG. 4C. The character string which is made up of the characters having the converted character attributes that are easily readable is displayed within the enlarged window opened in the step S16.

Therefore, it is possible to display in the enlarged window the converted character string which is made up of the characters having the unified character attribute which is easily readable on the display, by (i) setting the work table shown in FIG. 4A with respect to the input character string, (ii) referring to the attribute information conversion table 5*a* shown in FIG. 4B so as to convert the character string which is made up of the characters having the different character attributes into the converted character string, (iii) storing the converted character attribute for each character of the character string by rewriting the parameters in the work table if applicable, and (iv) reading the converted character string from the rewritten work table for display on the display unit 7.

In FIG. 4A, the work table prior to the data conversion includes the character codes "A", "b", "c", "D", "E" and "F" and the parameters related to each character code. The parameters in this particular case includes the character size, font type, color and slant angle, however, the parameters are of course not limited to those shown in FIG. 4A.

On the other hand, in FIG. 4B, the attribute information conversion table 5*a* includes the character size, font type, color, slant angle and delete indication as the parameters, however, the parameters are of course not limited to those shown in FIG. 4B. In this embodiment, it is assumed for the sake of convenience that the displayed characters are most easily readable and recognizable when the character size is 50 points, the font type is the bold Gothic, the color of the character display is in black, the slant angle of the character is 0°, and the delete indication is space, "*" or "#", but the parameters and the parameter values for making the character display most easily readable and recognizable are not limited to such. The "delete indication" indicates a portion of the character string to be deleted, and this delete indication may be made by successive spaces, "*"s or "#"s in the character string.

Furthermore, in FIG. 4C, the parameters of each of the character codes in the work table are unified for the input character string based on the attribute information conversion table 5*a* shown in FIG. 4B. As a result, the character size is set to 50 points, the font type is set to the bold Gothic, the color is set to black, and the slant angle is set to 0° for each character code. The rewriting of the work table shown in FIG. 4C depends upon the parameters set in the work table shown in FIG. 4A and the parameters and parameter values registered in the attribute information conversion table 5*a* shown in FIG. 4B for the purpose of making the characters most easily readable and recognizable on the display.

Next, a description will be given of the relationship between the original window and the enlarged window displayed on the display unit 7.

FIG. 5A shows an original window W1 displayed on the display unit 7, and an enlarged window W2 which is displayed at the bottom right portion of the display. On the other hand, FIG. 5B shows the original window W1, and the enlarged window W2 which is displayed at the bottom left portion of the display. In FIGS. 5A and 5B, a character string "AbcDEF" displayed within the original window W1 is converted into the converted character string "AbcDEF" which is more easily readable and recognizable using the attribute information conversion table 5*a*, and the converted character string "AbcDEF" is displayed within the enlarged window W2. Of course, the enlarged window W2 may be displayed at a location within the display so as not to overlap the original window W1 or, so as to prevent the contents of the original window W1 from being hidden behind the enlarged window W2. The enlarged window W2 may of course be displayed at the position of the original window W1 in place of the original window W1 by erasing the original window W1, for example.

Therefore, according to this embodiment, the input character string is automatically displayed within the enlarged window W2 in a most easily readable and recognizable form, by converting the attributes of the characters making up the input character string using the attribute information conversion table 5*a* and displaying the converted character string made up of the characters having a unified attribute that is easily readable and recognizable when displayed.

The input character string can be converted into the converted character string in various ways, but typical cases will now be described with reference to FIGS. 6A through 9B.

Figure 6A:
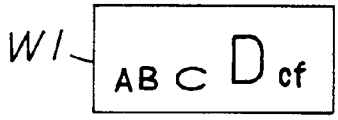
FIGS. 6A and 6B respectively are diagrams for explaining the display of the character string within the original and enlarged windows.
Figure 6B:
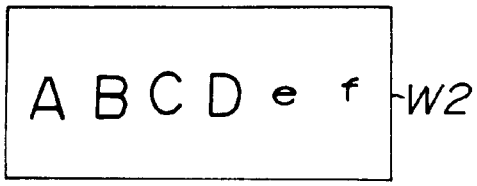

FIG. 6A shows an input character string "ABCDef" displayed within the original window W1, where the characters of this input character string have different character sizes. After the data conversion, the characters of the input character string are converted into the same character size which is easily readable and recognizable on the display, and the converted character string is displayed within the enlarged window W2 as shown in FIG. 6B.

Figure 7A:
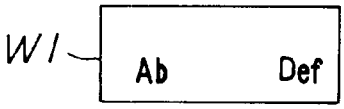
FIGS. 7A and 7B respectively are diagrams for explaining the display of the character string within the original and enlarged windows.
Figure 7B:
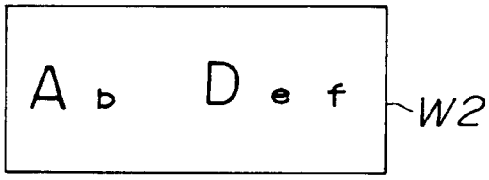

FIG. 7A shows an input character string "Ab Def" displayed within the original window W1, where the characters of this input character string include successive spaces, that is, delete indication. After the data conversion, the characters of the input character string are converted by deleting the successive and excessive spaces to leave only 1 space, for example, so that the converted character string is more easily readable and recognizable on the display, and the converted character string is displayed within the enlarged window W2 as shown in FIG. 7B. A similar data conversion may be made when successive "*"s or "#"s are included in the input character string as the delete indication.

Figure 8A:
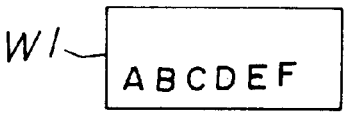
FIGS. 8A and 8B respectively are diagrams for explaining the display of the character string within the original and enlarged windows.
Figure 8B:
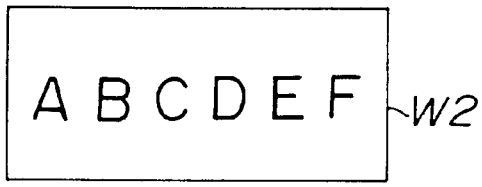

FIG. 8A shows an input character string "ABCDEF" displayed within the original window W1, where the characters of this input character string are displayed in white. After the data conversion, the color of the characters of the input character string is converted into black which is easily readable and recognizable on the display, and the converted character string is displayed within the enlarged window W2 as shown in FIG. 8B. Of course, a color other than black may be used as long as it is more easily readable and recognizable as compared to the original color used in the input character string.

Figure 9A:
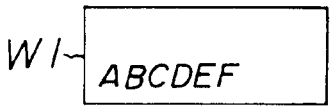
FIGS. 9A and 9B respectively are diagrams for explaining the display of the character string within the original and enlarged windows.
Figure 9B:
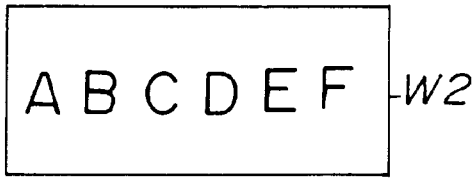

FIG. 9A shows an input character string "ABCDEF" displayed within the original window W1, where the characters of this input character string are slanted. After the data conversion, the characters of the input character string are converted to have no slant to be more easily readable and recognizable on the display, and the converted character string is displayed within the enlarged window W2 as shown in FIG. 9B. In other words, the font of the input character string is converted into a more easily readable and recognizable font in the converted character string.

Figure 10A:
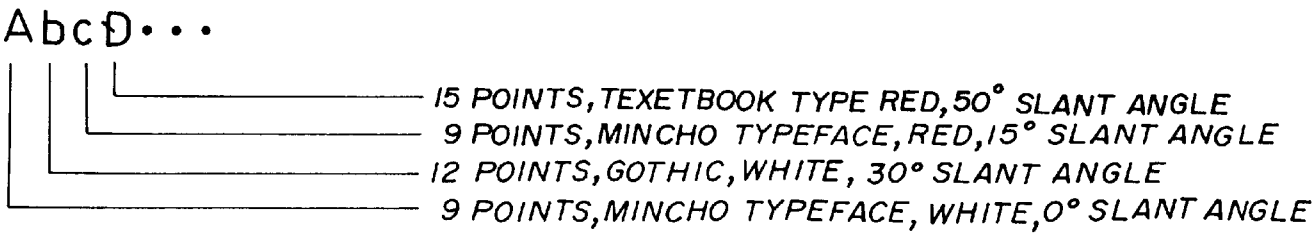
FIGS. 10A and 10B respectively are diagrams for explaining the change in the display of the character string before and after the data conversion.
Figure 10B:
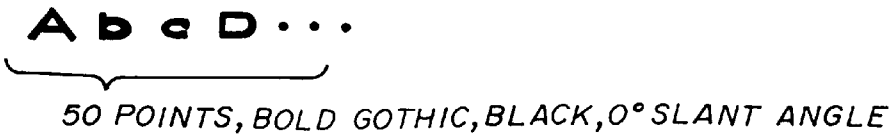

FIGS. 10A and 10B respectively are diagrams for explaining the change in the display of the character string before and after the data conversion.

FIG. 10A shows an original input character string "AbcD . . . " before the data conversion. The parameters of the attributes of each of the characters making up the input character string are shown on the righthand side in FIG. 10A. As shown, the character "A" has a character size of 15 points, a font type of textbook type, a color red, and a slant angle of 50°. The character "b" has a character size of 9 points, a font type of Mincho typeface, a color red, and a slant angle of 15°. The character "c" has a character size of 12 points, a font type of Gothic type, a color white, and a slant angle of 30°. In addition, the character "D" has a character size of 9 points, a font type of Mincho typeface, a color white, and a slant angle of 0°.

On the other hand, FIG. 10B shows the converted character string "AbcD . . . " after the data conversion. When the data conversion is carried out with respect to each of the characters making up the input character string shown in FIG. 10A using the attribute information conversion table 5*a*, the parameters of each character are unified to the values shown in FIG. 10B. More particularly, the character size is 50 points, the font type is bold Gothic, the color is black, and the slant angle is 0° for each of the characters making up the converted character string. The parameter values set with respect to each of the characters making up the converted character string make the converted character string more easily readable and recognizable as compared to the original input character string.

Figure 11:
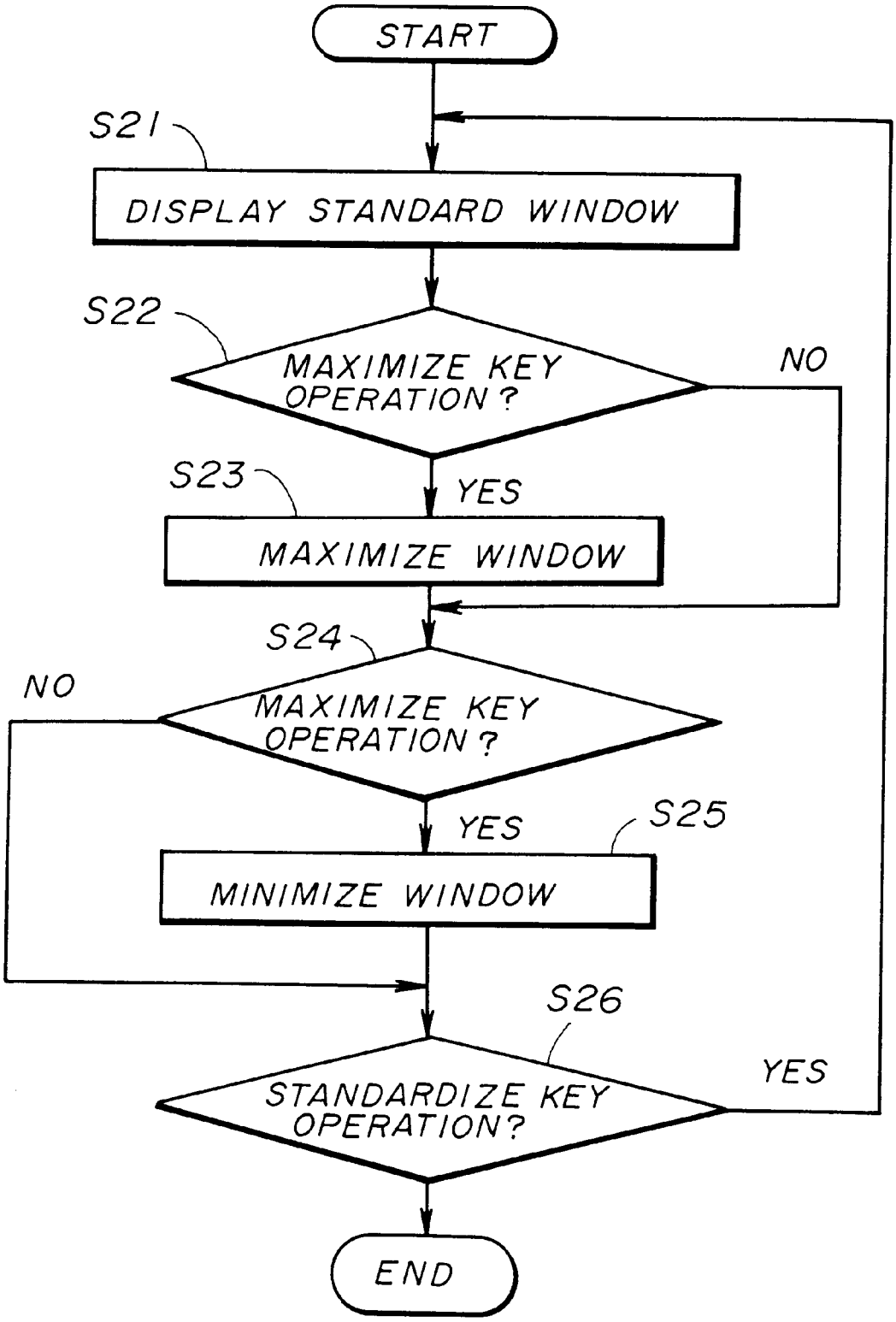
FIG. 11 is a flow chart for explaining the operation of switching a window size.

FIG. 11 is a flow chart for explaining the operation of switching a window size in the first embodiment. The process shown in FIG. 11 is included in the step S16 shown in FIG. 3.

In FIG. 11, a step S21 displays a standard window on the display unit 7. The standard window has a standard size which occupies a portion of the display such that the contents within the standard window are readable and recognizable. A step S22 decides whether or not a maximize key operation is made instructing the standard window to be enlarged and displayed at the maximum size. The enlarged window having the maximum size occupies approximately the entire display. For example, the maximize key operation can be made by clicking a portion of the standard window by the mouse to instruct the display at the maximum size, as in the case of a WINDOWS 95 operating system produced by Microsoft. If the decision result in the step S22 is YES, a step S23 enlarges the standard window and displays the window at the maximum size.

On the other hand, if the decision result in the step S22 is NO or after the step S23, a step S24 decides whether or not a minimize key operation is made instructing the standard or enlarged window to be displayed at a minimum size. The reduced window having the minimum size is not displayed on the display, but the application related to the reduced window continues to run. An icon may be displayed at a peripheral portion of the display to indicate that the window is reduced to the minimum size. For example, the minimize key operation can be made by clicking a portion of the window by the mouse to instruct the display at the minimum size, as in the case of the WINDOWS 95 operating system. If the decision result in the step S24 is YES, a step S25 reduces the window and displays the window at the minimum size.

If the decision result in the step S24 is NO or after the step S25, a step S26 decides whether or not a standardize key operation is made instructing the window to be displayed at the standard size. For example, the standard key operation can be made by clicking a portion of the window by the mouse to instruct the display at the standard size, as in the case of the WINDOWS 95 operating system. If the decision result in the step S26 is YES, the process returns to the step S21. On the other hand, the process ends if the decision result in the step S26 is NO.

Next, a description will be given of a second embodiment of the display control apparatus according to the present invention. This embodiment of the display control apparatus employs a second embodiment of the display control method according to the present invention and a second embodiment of the computer program product according to the present invention.

Figure 12:
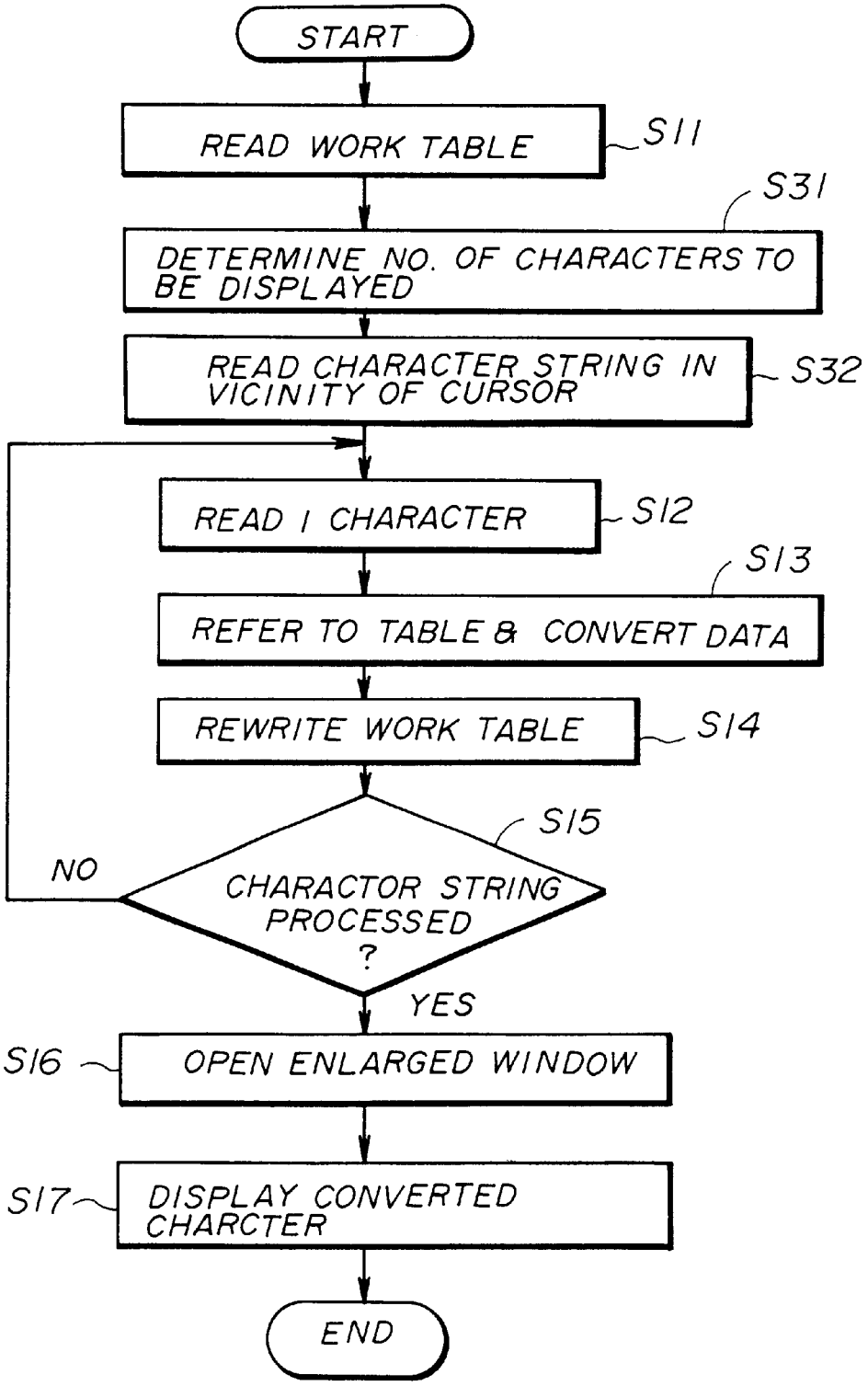
FIG. 12 is a flow chart for explaining the operation of converting and displaying characters in a second embodiment of the display control apparatus according to the present invention.

In this embodiment, the construction of the display control apparatus is the same as that shown in FIG. 1. However, the operation of the converting and displaying characters is as shown in FIG. 12. FIG. 12 is a flow chart for explaining the operation of the display control apparatus, more particularly, the operation of the CPU forming the display control apparatus, when converting and displaying the characters, so that the displayed character string is made up of characters having a unified character attribute that are more easily readable on the display in this embodiment. Hence, FIG. 12 corresponds to an important part of the second embodiment of the display control method. In FIG. 12, those steps which are the same as those corresponding steps in FIG. 3 are designated by the same reference numerals, and a description thereof will be omitted.

In FIG. 12, steps S31 and S32 are provided between the steps S11 and S12. The step S31 determines the number of characters of the converted character string to be displayed, and also determines the size of the window in which the converted character string is to be displayed. Both the window size and the number of characters to be displayed within the window can be determined from the character size registered in the attribute information conversion table 5*a*.

Figure 13B:
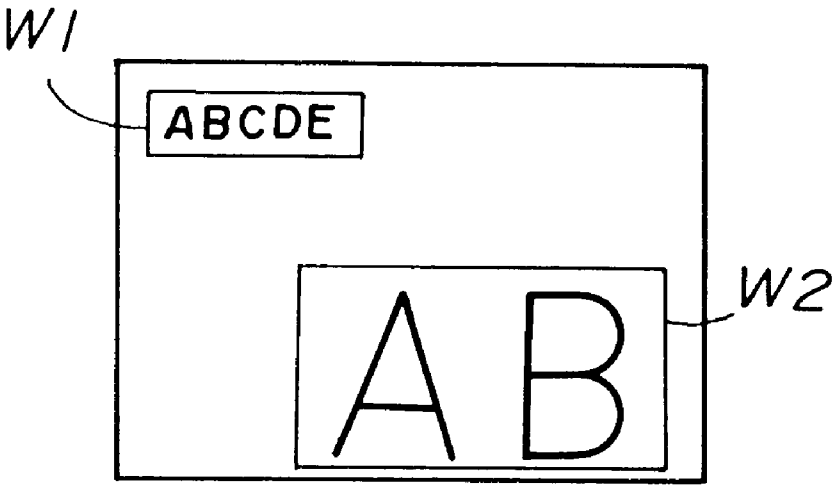
FIGS. 13A and 13B respectively are diagrams for explaining the operation of determining the window size and the number of characters displayed within the window.
Figure 13A:
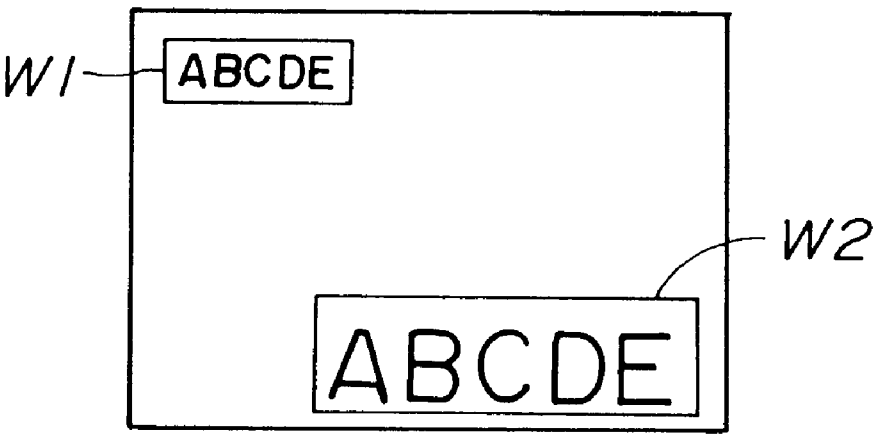

FIG. 13A shows the original window W1 and the enlarged window W2 for a case where the character size of the converted character string is relatively small compared to the enlarged window W2. In this particular case, all of the characters of the character string "ABCDE" within the original window W1 can be displayed within the enlarged window W2.

On the other hand, FIG. 13B shows the original window W1 and the enlarged window W2 for a case where the character size of the converted character string is relatively large compared to the enlarged window W2. In this particular case, not all of the characters of the character string "ABCDE" within the original window W1 can be displayed within the enlarged window W2, and only the characters "A" and "B" are displayed within the enlarged window W2.

Therefore, depending on the parameters registered in the attribute information conversion table 5*a*, the step S31 can suitably determine the window size and the number of characters of the converted character string to be displayed within the window so as to best suit the user's needs.

The step S32 reads a character string in a vicinity of a cursor which is displayed on the display unit 7. Alternatively, the step S32 may read a character string in a vicinity of a pointer when the mouse is clicked. Thereafter, the step S12 reads 1 character from the character string which is read in the step S32, and the process described above in conjunction with FIG. 3 is carried out.

Of course, the attribute information is not limited to the character size, font type, color, slant angle, rotation angle, character pitch and delete indication described above. For example, the attribute information may include decorative indications or information such as a single delete line and double delete lines, and underline information. The underline information may include an underline, no underline, single underline, double underline, dotted line, chain lines and the like.

In the embodiments described above, the original input character string is converted and displayed within a window which is enlarged from the original window size containing the original input character string. However, it is not essential to display the converted character string within an enlarged window, and the converted character string may be displayed within a window having the same size as the original window size or having a smaller size than the original window size, as long as the converted character string is more easily readable and recognizable compared to the original character string. In addition, the characters of the original character string do not necessarily have to be enlarged in the converted character string, and the characters of the converted character string may be displayed at the original size or at a size smaller than the original size, as long as the converted character string is more easily readable and recognizable compared to the original character string. In other words, only the color may be converted between the original character string and the converted character string.

Moreover, when making the data conversion using the attribute information conversion table 5*a*, it is not essential to convert a plurality of attributes, and it is appropriate to convert only one of the attributes depending on the application.

Further, the present invention is not limited to these embodiments, but various variations and modifications may be made without departing from the scope of the present invention.

What is claimed is:

1. A display control apparatus which controls attributes of characters to be displayed on a display unit, said display control apparatus comprising:

a user definable attribute information conversion table which includes information for converting a plurality of different attributes into a predetermined attribute;

a converter converting an input character string, of plural characters of respective, different attributes, to a converted character string, of plural corresponding characters of the predetermined attribute, in accordance with the attribute information conversion table, with the conversion of the input character string to the converted character string being triggered upon an initiation to display the input character string with a varied magnification; and an output device to display, upon the initiation to display the input character with a varied magnification, said converted character string on the display unit.

2. The display control apparatus as claimed in claim 1, wherein said attributes are parameter values of attribute information selected from a group including character size, font type, color, slant angle, rotation angle, character pitch, delete indication, decorative information and underline information.

3. The display control apparatus as claimed in claim 2, wherein said decorative information is selected from a group including a single delete line and double delete lines, and said underline information is selected from a group consisting of underline, no underline, single underline, double underline, dotted line and chain line.

4. The display control apparatus as claimed in claim 2, wherein said attribute information conversion table stores parameter values of at least two attribute information selected from said group.

5. The display control apparatus as claimed in claim 2, which further comprises:

a unit determining a size of a window in which the converted character string is to be displayed on the display unit and a number of characters of the converted character string to be displayed within said window based on a character size stored in said attribute information conversion table.

6. The display control apparatus as claimed in claim 1, which further comprises:

means for storing attributes in said attribute information conversion table.

7. The display control apparatus as claimed in claim 1, which further comprising:

means for rewriting attributes in said attribute information conversion table.

8. The display control apparatus as claimed in claim 1, wherein said predetermined attributes stored in said attribute information conversion table are set so that readability and recognizability of the converted character string on the display unit are optimized upon said magnification.

9. The display control apparatus of claim 1, wherein each character of the input character string has a plurality of attribute values which form a combination.

10. The display control apparatus as claimed in claim 1, wherein said converter converts the input character string to the converted character string when making an enlarged magnification display on the display unit.

11. A display control method which controls attributes of characters to be displayed on a display unit, said display control method comprising:

storing a user definable attribute information conversion table which includes information for converting a plurality of different attributes into a predetermined attribute;

converting an input character string, of plural characters of respective, different attributes, to a converted character string, of plural corresponding characters of the predetermined attribute, in accordance with the attribute information conversion, with the conversion of the input character string to the converted character string being triggered upon an initiation to display the input character string with a varied magnification; and outputting said converted character string for display on the display unit.

12. The display control method as claimed in claim 11, wherein said attributes are parameter values of attribute information selected from a group including character size, font type, color, slant angle, rotation angle, character pitch, delete indication, decorative information and underline information.

13. The display control method as claimed in claim 12, wherein said decorative information is selected from a group including single delete line and double delete lines, and said underline information is selected from a group consisting of underline, no underline, single underline, double underline, dotted line and chain lines.

14. The display control method as claimed in claim 12, wherein said storing of attribute information conversion table includes storing in said attribute information conversion table parameter values of at least two attribute information selected from said group.

15. The display control method as claimed in claim 12, which further comprises:

determining a size of a window in which the converted character string is to be displayed on the display unit and a number of characters of the converted character string to be displayed within said window based on character size stored in said attribute information conversion table.

16. The display control method as claimed in claim 11, which further comprises:

storing attributes in said attribute information conversion table.

17. The display control method as claimed in claim 11, which further comprises:

rewriting attributes in said attribute information conversion table.

18. The display control method as claimed in claim 11, wherein said storing of attribute information conversion table includes setting said predetermined attributes stored in said attribute information conversion table so that readability and recognizability of the converted character string on the display unit are optimized upon said magnification.

19. The display control method of claim 11, wherein a combination of the attribute values is different for at least two characters of the input character string.

20. The display control method as claimed in claim 11, wherein said converting of an input character string includes converting the input character string to the converted character string when making an enlarged magnification display on the display unit.

21. A computer program product including a computer readable medium having computer program logic recorded thereon causing a computer to perform an attribute conversion with respect to characters to be displayed on a display unit, said computer program product comprising:

a storage unit to cause the computer to store a user definable attribute information conversion table which includes information for converting a plurality of different attributes into a predetermined attribute;

a converter unit to cause the computer to convert an input character string, of plural characters of respective, different attributes, to a converted character string, of plural corresponding characters of the predetermined attribute, in accordance with the attribute information conversion table, with the conversion of the input character string to the converted character string being triggered upon an initiation to display the input character string with a varied magnification; and an outputting unit to cause the computer to output said converted character string for display on the display unit.

22. The computer program product as claimed in claim 21, wherein said attributes are parameter values of attribute information selected from a group consisting of character size, font type, color, slant indication, decorative information and underline information.

23. The computer program product as claimed in claim 22, wherein said decorative information is selected from a group consisting of single delete line and double delete lines, and said underline information is selected from a group consisting of underline, no underline, single underline, double underline, dotted line and chain line.

24. The computer program product as claimed in claim 22, wherein said storage unit causes the computer to store the parameter values of at least two attribute information selected from said group.

25. The computer program product as claimed in claim 22, which further comprises:

a determination unit to cause the computer to determine a size of a window in which the converted character string is to be displayed on the display unit and a number of characters of the converted character string to be displayed within said window based on a character size stored in said storage unit.

26. The computer program product as claimed in claim 21, which further comprises:

a storing unit to cause the computer to store attributes in said storage unit.

27. The computer program product as claimed in claim 21, which further comprises:

a rewriting unit to cause the computer to rewrite attributes in said storage unit.

28. The computer program product as claimed in claim 21, wherein said storage unit sets the predetermined attributes to be stored by the computer so that readability and recognizability of the converted character string on the display unit are optimized upon said magnification.

29. The computer program product of claim 21, wherein the converter automatically converts each character of the input character string so as to have a same combination of attribute values.

30. The computer program product as claimed in claim 21, wherein said converter unit causes the computer to convert the input character string to the converted character string when making an enlarged magnification display on the display unit.

31. A display control apparatus which controls attributes of characters to be displayed on a display unit, said display control apparatus comprising:

an attribute information conversion table which includes information for converting a plurality of different attributes into a predetermined attribute;

a converter converting an input character string, of plural characters of respective, different attributes, to a converted character string, of plural corresponding characters of the predetermined attribute, in accordance with the attribute information conversion table, when displaying the input character string with a varied magnification; and an output device outputting said converted character string on the display unit, wherein said attributes are parameter values of attribute information selected from a group including character size, font type, color, slant angle, rotation angle, character pitch, delete indication, decorative information and underline information, and said attribute information conversion table stores a parameter value for the delete indication so that said converter converts a succession of spaces or a symbol in the input character string as a succession of a predetermined number of spaces or said symbol.

32. A display control method which controls attributes of characters to be displayed on a display unit, said display control method comprising:

storing an a user definable attribute information conversion table which includes information for converting a plurality of different attributes into a predetermined attribute;

converting an input character string, of plural characters of respective, different attributes, to a converted character string, of plural corresponding characters of the predetermined attribute, in accordance with the attribute information conversion, when displaying the input character string with a varied magnification; and outputting said converted character string for display on the display unit, wherein said attributes are parameter values of attribute information selected from a group including character size, font type, color, slant angle, rotation angle, character pitch, delete indication, decorative information and underline information, and said storing of attribute information conversion table includes storing in said attribute information conversion table a parameter value for the delete indication so that said converting of input an character string includes converting a succession of spaces or a symbol in the original character string as a succession of a predetermined number spaces or said symbol.

33. A computer program product including a computer readable medium having computer program logic recorded thereon causing a computer to perform an attribute conversion with respect to characters to be displayed on a display unit, said computer program product comprising:

a storage unit to cause the computer to store an attribute information conversion table which includes information for converting a plurality of different attributes into a predetermined attribute;

a converter unit to cause the computer to convert an input character string, of plural characters of respective, different attributes, to a converted character string, of plural corresponding characters of the predetermined attribute, in accordance with the attribute information conversion table, when displaying the input character string with a varied magnification; and an outputting unit to cause the computer to output said converted character string for display on the display unit, wherein said attributes are parameter values of attribute information selected from a group consisting of character size, font type, color, slant indication, decorative information and underline information, and said storage unit causes the computer to store a parameter value for the delete indication so that said converter unit converts a succession of spaces or a symbol in the original character string as a succession of a predetermined number spaces or said symbol.

34. A display control apparatus which controls attributes of characters to be displayed on a display unit, said display control apparatus comprising:

an attribute information conversion table which includes information for converting a plurality of different attributes into a predetermined attribute;

a converter converting an input character string, of plural characters of respective, different attributes, to a converted character string, of plural corresponding characters of the predetermined attribute, in accordance with the attribute information conversion table; and an output device outputting said converted character string for display on the display unit, wherein said attributes are parameter values of attribute information selected from a group including character size, font type, color, slant angle, rotation angle, character pitch, delete indication, decorative information and underline information, and said attribute information conversion table stores a parameter value for the delete indication so that said converter converts a succession of spaces or a symbol in the original character string as a succession of a predetermined number of spaces or said symbol.

35. A display control method which controls attributes of characters to be displayed on a display unit, said display control method comprising:

(a) storing an attribute information conversion table which includes information for converting a plurality of different attributes into a predetermined attribute;

(b) converting an input character string, of plural characters of respective, different attributes, to a converted character string, of plural corresponding characters of the predetermined attribute, in accordance with the attribute information conversion table; and (c) outputting said converted character string for display on the display unit, wherein said attributes are parameter values of attribute information selected from a group including of character size, font type, color, slant angle, rotation angle, character pitch, delete indication, decorative information and underline information, and said step (a) stores in said attribute information conversion table a parameter value for the delete indication so that said step (b) converts a succession of spaces or a symbol in the original character string as a succession of a predetermined number spaces or said symbol.

36. A computer program product including a computer readable medium having computer program logic recorded thereon causing a computer to perform an attribute conversion with respect to characters to be displayed on a display unit, said computer program product causing the computer to:

store an attribute information conversion table which includes information for converting a plurality of different attributes into a predetermined attribute;

convert an input character string, of plural characters of respective, different attributes, to a converted character string, of plural corresponding characters of the predetermined attribute, in accordance with the attribute information conversion table; and output said converted character string for display on the display unit, wherein said attributes are parameter values of attribute information selected from a group including of character size, font type, color, slant angle, rotation angle, character pitch, delete indication, decorative information and underline information, and said attribute information conversion table stores a parameter value for the delete indication so that said converting step converts a succession of spaces or a symbol in the original character string as a succession of a predetermined number spaces or said symbol.

37. A computer program product including a computer readable medium having computer program logic recorded thereon causing a computer to perform an attribute conversion with respect to characters to be displayed on a display unit, said computer program product comprising:

a storage unit to store a user definable attribute information conversion table which includes information for converting a plurality of different attributes into a predetermined attribute;

a converter unit to cause the computer to convert an input character string, of plural characters of respective, different attributes, to a converted character string, of plural corresponding characters of the predetermined attribute, in accordance with the attribute information conversion table, with the conversion of the input character string to the converted character string being triggered upon an initiation to display the input character string with a varied magnification; and an outputting unit to cause the computer to output said converted character string for display on the display unit.

38. A display control apparatus which controls attributes of characters to be displayed on a display unit, said display control apparatus comprising:

an attribute information conversion table which includes information for converting a plurality of different attributes into a predetermined attribute;

a converter converting an input character string, of plural characters of respective, different attributes, to a converted character string, of plural corresponding characters of the predetermined attribute, in accordance with the attribute information conversion table and in a single automated operation, when displaying the input character string with a varied magnification; and an output device outputting said converted character string for display on the display unit.

39. A display control method which controls attributes of characters to be displayed on a display unit, said display control method comprising:

storing an attribute information conversion table which includes information for converting a plurality of different attributes into a predetermined attribute;

converting an input character string, of plural characters of respective, different attributes, to a converted character string, of plural corresponding characters of the predetermined attribute, in accordance with the attribute information conversion table and in a single automated operation, when displaying the input character string with a varied magnification; and outputting said converted character string for display on the display unit.

40. A computer program product including a computer readable medium having computer program logic recorded thereon causing a computer to perform an attribute conversion with respect to characters to be displayed on a display unit, said computer program product comprising:

a storage unit to cause the computer to store an attribute information conversion table which includes information for converting a plurality of different attributes into a predetermined attribute;

a converter unit to cause the computer to convert an input character string, of plural characters of respective, different attributes, to a converted character string, of plural corresponding characters of the predetermined attribute, in accordance with the attribute information conversion table and in a single automated operation, when displaying the input character string with a varied magnification; and an outputting unit to cause the computer to output said converted character string for display on the display unit.

41. A computer program product including a computer readable medium having computer program logic recorded thereon causing a computer to perform an attribute conversion with respect to characters to be displayed on a display unit, said computer program product comprising:

a storage unit to store an attribute information conversion table which includes information for converting a plurality of different attributes into a predetermined attribute;

a converter unit to cause the computer to convert an input character string, of plural characters of respective, different attributes, to a converted character string, of plural corresponding characters of the predetermined attribute, in accordance with the attribute information conversion table and in a single automated operation, when displaying the input character string with a varied magnification; and an outputting unit to cause the computer to output said converted character string for display on the display unit.

* * * * *